US005495724A

United States Patent [19]

Koster

[11] Patent Number: 5,495,724

[45] Date of Patent: Mar. 5, 1996

[54] COOLING SYSTEM

[76] Inventor: Helmut Koster, Karl-Bieber-Hohe 15, D-6000, Frankfurt am Main, Germany

[21] Appl. No.: 39,344

[22] Filed: Jun. 14, 1993

[30] Foreign Application Priority Data

Aug. 20, 1991 [DE] Germany ..... 41 27 479.2
May 15, 1992 [DE] Germany ..... 42 16 136.3

[51] Int. Cl.[6] ..... F25D 23/12; F24F 5/00

[52] U.S. Cl. ..... 62/259.1; 62/DIG. 16; 62/272; 165/53; 454/296; 454/298

[58] Field of Search ..... 62/93, 99, 259.1, 62/373, 272, 406, DIG. 16; 165/50, 53, 56, 128, 129; 454/296, 298

[56] References Cited

U.S. PATENT DOCUMENTS

| | | | |
|---|---|---|---|
| Re. 24,637 | 4/1959 | Wulle | 454/298 |
| 316,292 | 4/1885 | Rankin | 165/53 X |
| 2,662,743 | 12/1953 | Frenger | 454/296 X |
| 2,751,198 | 6/1956 | Rapp | 165/56 |
| 3,188,458 | 6/1965 | Hickman | 165/53 X |
| 3,244,223 | 4/1966 | Edwards | 165/50 X |
| 3,369,540 | 2/1968 | Meckler | 165/53 |
| 4,099,941 | 7/1978 | Gutermuth et al. . | |
| 4,586,346 | 5/1986 | St. Pierre | 62/DIG. 16 X |
| 4,918,934 | 4/1990 | Mayer et al. | 165/128 X |
| 4,993,630 | 2/1991 | Reichel et al. | 165/49 X |

FOREIGN PATENT DOCUMENTS

| | | | |
|---|---|---|---|
| 0231121 | 9/1988 | Japan | 62/DIG. 16 |
| 0234727 | 9/1989 | Japan | 62/DIG. 16 |

*Primary Examiner*—Christopher Kilner
*Attorney, Agent, or Firm*—Koda and Androlia

[57] ABSTRACT

A cooling system which can be fastened on a ceiling with a suspension provided beneath the ceiling disposed above a space to be cooled and with cooling pipes between the ceiling and the suspension wherein the space to be cooled and the space between the ceiling and the suspension are connected with each other through air current paths.

13 Claims, 4 Drawing Sheets

COOLING SYSTEM

BACKGROUND OF THE INVENTION

1. Field of the Invention

The invention relates to a cooling system with a suspended ceiling disposed underneath cooling pipes.

2. Prior Art

Different heating or cooling systems for the regulation of temperature in a space are known. If these systems use a particular heating or cooling medium, for example a fluid, they can as a rule serve as a cooling as well as also a heating system. Therefore conventional hot water heating systems could in principle also act as cooling or air-conditioning installations if, for example water of 2° C. were to flow in it. Nevertheless, heating and cooling technologies have developed to some extent separate from one another which is also related to the fact that the cooling technology is technically more difficult to master than the heating technology. While, as a rule, in heating technology only heat accumulates regardless of whether or not the process is one of combustion or resistance heating, in the cooling process heat also accumulates which must be dissipated. This fundamental difference is, however, without great significance if only the end apparatus is considered through which flow or steam the cooled/heated media.

Dealing separately with cooling and heating systems is also appropriate for the reason that hot air rises while cold air falls. Because of this physical effect it is reasonable to utilize the floor of a space for heating and the ceiling of this space for cooling.

Numerous ceilings are already known in which relatively thick pipes or also capillary pipes through which a cooling medium flows are either installed directly in a ceiling or disposed in a suspended ceiling (Marktübersicht Kühldecken (Market Review Cooling Ceiling), Journal "Trockenbau", 1991, No. 7, pp. 46 to 51). In these cooling ceilings the cooling takes place through direct contact of the cooling pipe with a radiating ceiling or a radiating sheet metal.

An arrangement for ceiling cooling is also known in which cooling pipes extend between the space ceiling proper and a suspended ceiling (DE-OS 14 84 065). However, these cooling pipes are embedded in a heat-conducting carrier which, in turn, has a metal connection with the suspended ceiling giving off the cooling.

Furthermore, a subceiling is known having cooling pipes through which flows a cooling medium and the metal of which is in direct contact with arcuate heat-radiating metal sheets (DE-OS 27 12 592). However, this subceiling has a low degree of cooling efficiency.

Further is known a cooling ceiling for space air cooling having heat guidance rails suspended from a ceiling and through which flows cooling water (DE-GM 91 02 260). Ceiling elements are detachably disposed on those heat guidance rails. This cooling ceiling also has only a relatively low cooling effect. Moreover it offers no solution to the problems of condensation water.

Lastly, a suspended ceiling is also known which is disposed below a space ceiling and above which are disposed cooling pipes through which flows a cooling medium (USSR Patent 740 059; Reichel: Klimakomponente Kühldecke, Journal "Technik am Bau", No. 4, 1989, pp. 325 to 327). In the case of this ceiling the degree of cooling is also relatively poor.

SUMMARY OF THE INVENTION

The invention is based on the task of creating a cooling system which can be disposed on a ceiling, is visually attractive and has a high degree of cooling efficiency.

The advantage achieved with the invention resides in particular therein that a ceiling which appears largely closed results although the suspended ceiling is not closed and permits hereby cooling by convection. Through the openings in the suspended ceiling the hot air of the space to be cooled arrives at the cooling pipes, washes around them and is cooled down by them. Hereupon the cooled air sinks downward. This very effective convection cooling system can additionally be combined with a heat conduction cooling in which the cooling pipes are in physical contact with the suspended ceiling. Through the integration of a condensation water channel it is possible to increase the cooling power upon falling below the dew point.

BRIEF DESCRIPTION OF THE DRAWINGS

Embodiment examples of the invention are depicted in the drawing and will be described in greater detail in the following. Therein show.

DETAILED DESCRIPTION OF THE INVENTION

Figure 1:
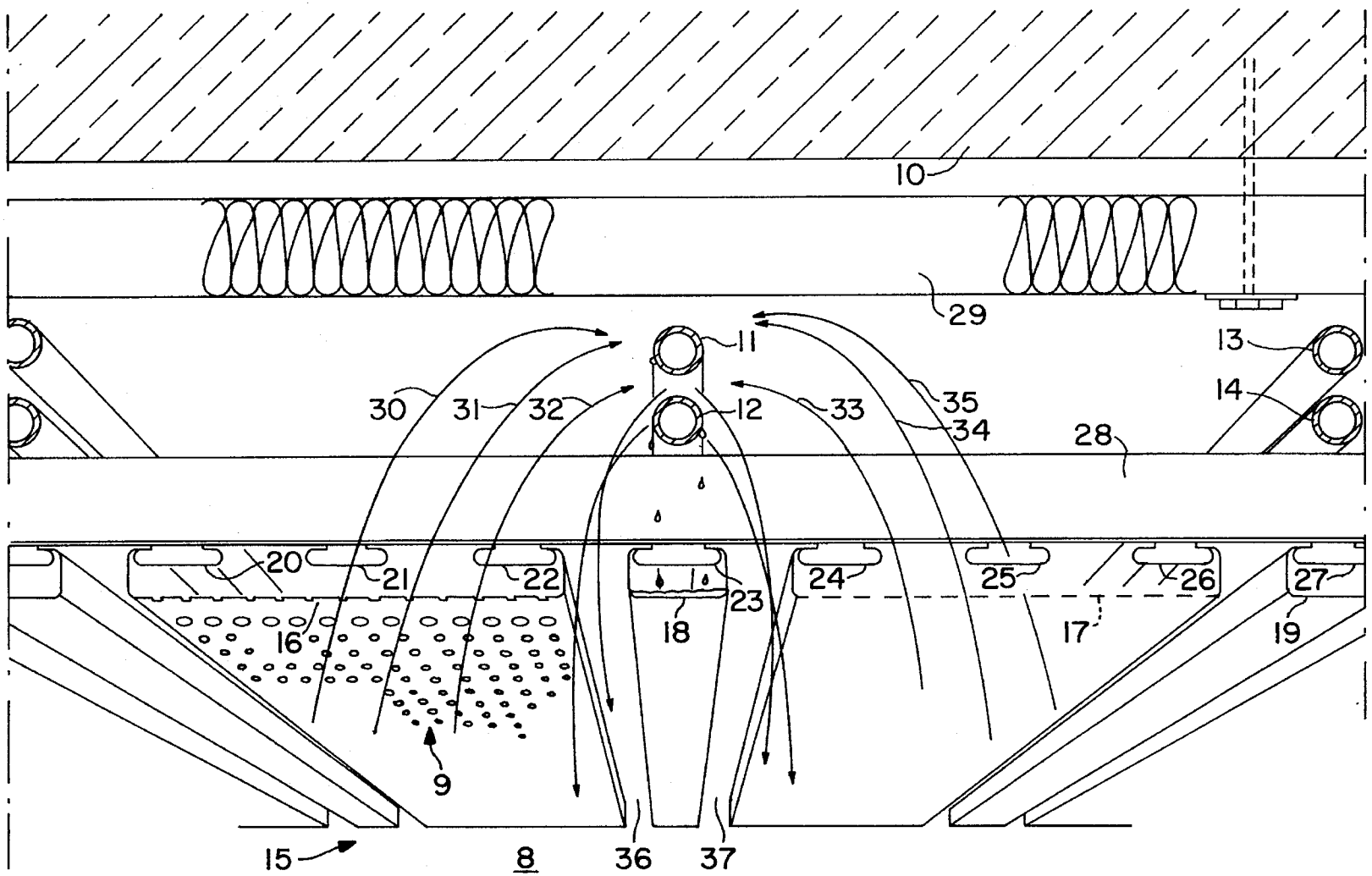
FIG. 1—a ceiling cooling system with a suspended ceiling and cooling pipes.

FIG. 1 shows a perspective section through a cooling system according to the invention. Herein can be seen a concrete ceiling 10 below which are disposed several cooling pipes 11 to 14, of which in each instance two cooling pipes 11, 12 or 13, 14 are disposed one above the other. Each pair of the cooling pipes 11, 12 or 13, 14 respectively, disposed one above the other has a given distance from the adjacent pair of cooling pipes.

Underneath the cooling pipes is provided a suspended ceiling 15 comprising several plates or panels 16 to 19. These panels 16 to 19 are alternating narrow and wide panels wherein the narrow panels 18, 19 are disposed directly underneath the cooling pipes 11, 12 or 13, 14 respectively. Between the narrow and the wide panels are provided interspaces 36, 37 through which cooled air from the cooling pipes 11, 12 or 13, 14 respectively can fall downward into space 8 to be cooled.

The panels are suspended on mounting elements 20 to 27 which, in turn, are disposed on a carrier rail 28 extending transversely.

This carrier rail 28 serves simultaneously as a type of spacer for the pipes 11, 12 or 13, 14 respectively, i.e. the lowermost pipe 12 or 14 rests on this carrier rail 28.

Between the cooling pipes 11 to 14 and the concrete ceiling 10 is provided a damping layer 29 serving essentially for the purpose of acoustic damping.

The wide panels are provided with apertures 9 through which hot air denoted by the reference numbers 30 to 35 can flow upward to the cooling pipes 11 to 14.

Through the apertures 9, on the one hand, and the interspaces 36, 37 on the other, an air current circulation is formed in which the hot air follows a first flow path and the cold air a second flow path.

The narrow panels 18 have no apertures but rather they are implemented as condensation channels. The perspiration or condensation 6 forming with strong cooling at the pipes 11 to 14 drips into panels 18, 19 which are open in the upward direction and is retained there or flows toward one end of the panels 18, 19.

In order to avoid the dripping of condensation water onto the carrier rail 28, the cooling pipes 11 to 14 are provided with heat-insulating packing in the region of the carrier rails 28.

Figure 2:
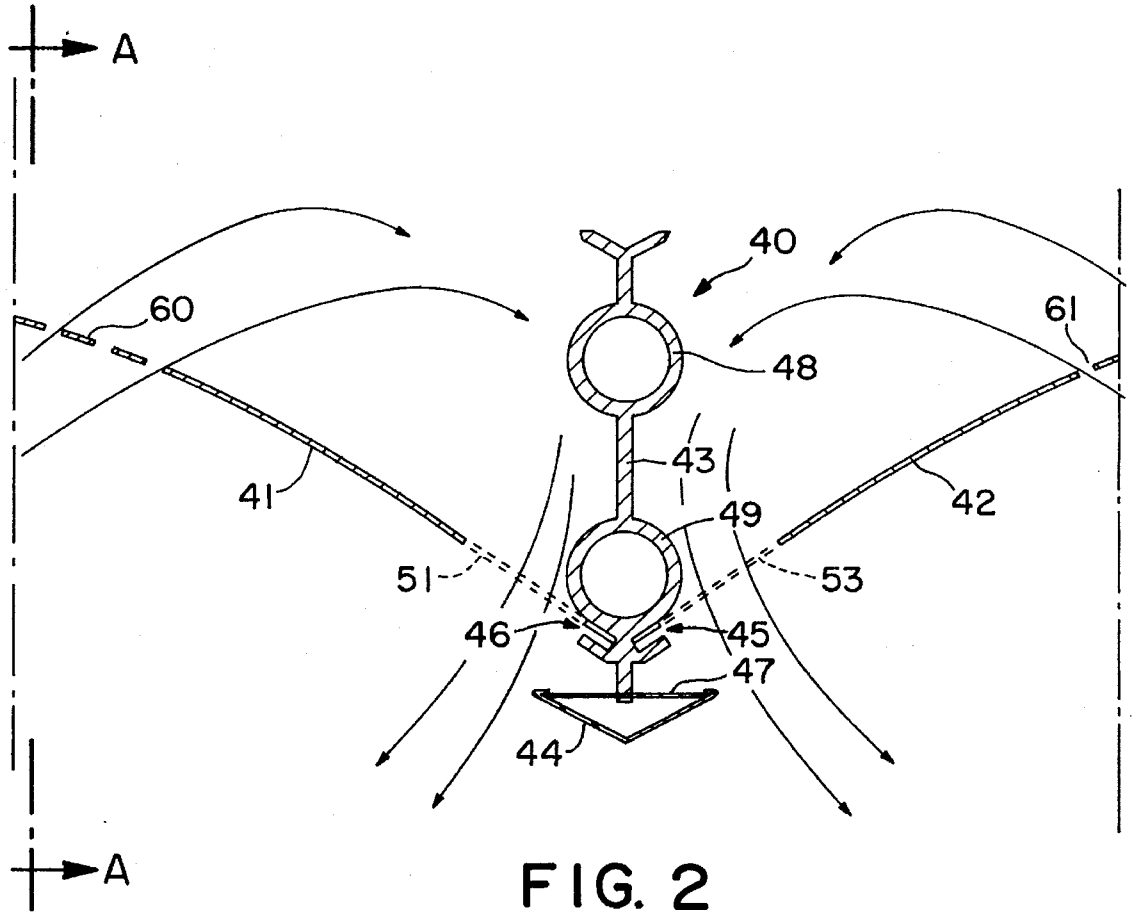
FIG. 2—a special embodiment of the cooling pipes and the suspended ceiling.

In FIG. 2 is depicted a further embodiment example of the invention. Herein can be seen two panels 41, 42 which are arcuate and which meet in a common point. Above this common point are disposed one above the other two cooling pies 49, 48 connected with one another via a web 43. These cooling pipes 48, 49 together form the cooling pipe system 40 which has at its lower end receiving seats 45, 46 for the panels 41, 42. Underneath these receiving seats 45, 46 is disposed a condensation channel 44 connected via a mounting element 47 with the lower cooling pipe 49. Each of the panels 41, 42 has at two different sites breakthroughs 51, 53 or 60, 61 respectively. Through the breakthroughs 61, 53 the warm air of the space to be cooled flows to the cooling pipes 48, 49 where it is cooled down. From there the cooled air falls through the breakthroughs 51, 60 downward into the space to be cooled. Condensation water potentially accumulating at the cooling pipes 48, 49 drips into the condensation water channel 44. Through the web disposed between the two cooling pipes 48, 49 it is ensured that even the condensation of the upper cooling pipe 48 flows drip-free in the downward direction.

Panels 41, 42 are parabolic elements and snapped with their one end into the receiving seats 45, 46.

The cooling pipes 48, 49 serve as forward as well as also return pipes. Instead of two cooling pipes can also be disposed several cooling pipes one above the other and/or one beside the other. In the case of a pipe bundle of this type, some pipes can be used as heating and others as cooling pipes. The heating or cooling medium can be any fluid, preferably however water or steam. Pipes 48, 49 can also serve as part of a sprinkler installation if they are connected to a pressure water piping.

Figure 3:
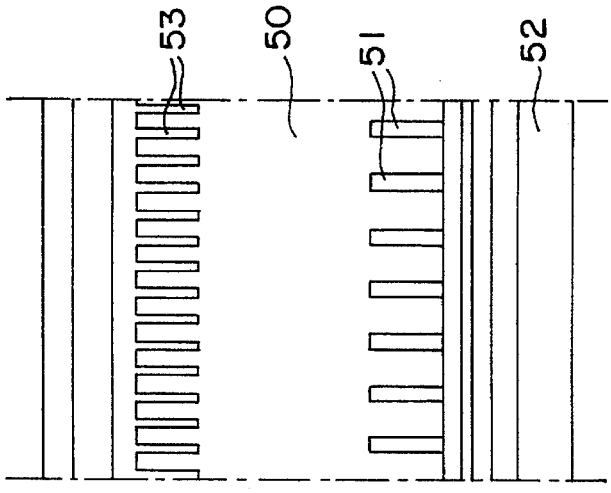
FIG. 3—a side view of a metal sheet of a suspended ceiling.

In FIG. 3 is represented a side view of panel 42. The breakthroughs 53 can herein be seen in the upper region through which the hot air flows as well as the breakthroughs 51 in the lower region through which the cooled air flows. The breakthroughs are herein implemented as slits; they can, however, also be implemented as holes.

Figure 4:
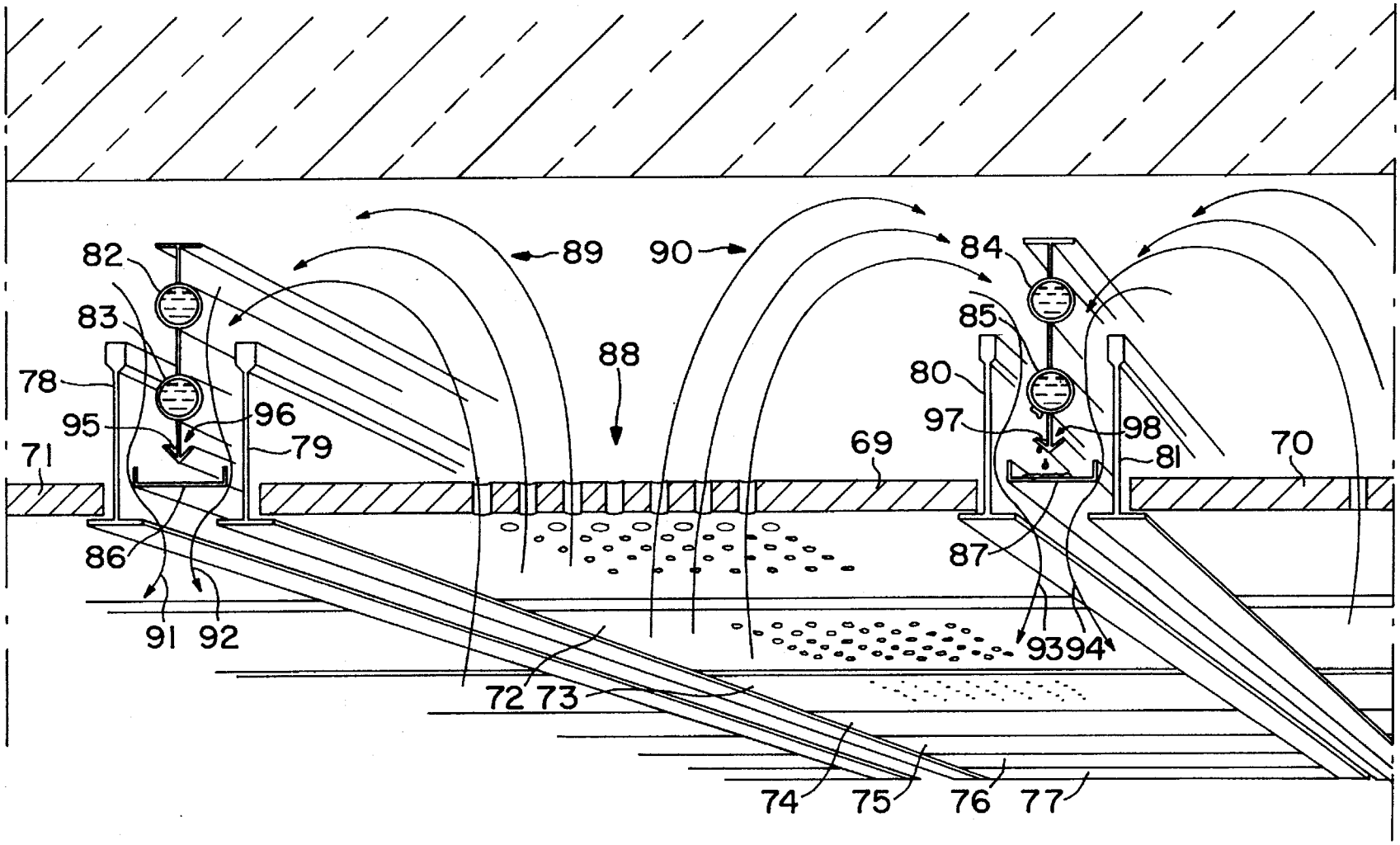
FIG. 4—a variant of a suspended ceiling in which the openings in the suspended ceiling can be closed off.

FIG. 4 shows a further variant of the invention in which the sound damping plate 29 provided in FIG. 1 is omitted. Moreover, instead of alternating small and large panels, a suspended ceiling 69 to 71 is provided which is essentially continuous and which includes slits.

The suspended ceiling 69 to 71 itself assumes herein the function of a sound damping plate. In the example of FIG. 4 the suspended ceiling has three individual plates 69, 70, 71 in the horizontal direction. Between these individual plates 69, 70, 71 and extending perpendicularly to them are disposed two parallel carrier rails 78, 79 or 80, 81 respectively. On the transverse web of these carrier T-rails 78 to 81 rest the ends of the individual plates 69 to 71. In the direction toward the plane of drawing further plates 54, 72 to 77 adjoin the individual plates 69 to 71. The individual plates 54, 72 to 77 or 69 to 71 can consequently be placed between the greater distances of the carrier rails 78 to 81. The individual plates 54, 72 to 77 or 69 to 71 are provided at least in the their central region with bores 88 through which the hot air from the space to be cooled can flow into the space between suspended ceiling and concrete ceiling 10. Into the smaller distances between the carrier rails 78 to 81 are inserted U-rails 86, 87 which do not rest on the T-rails 78 to 81 but rather are at a distance from the supports. Hereby, on the one hand, a flow of cold air from the space between the concrete ceiling 10 and the suspended ceiling to the space to be cooled is made possible and, on the other hand, a visual closure is achieved which makes the suspended ceiling appear essentially smooth when viewed from below.

Through the bores 88 in plates 69 to 71 and 54, 72 to 77 an air flow circulation from the space to be cooled into the space between suspended ceiling and concrete ceiling is made possible. The rising air is depicted by lines 89, 90 while the sinking of the cooled air is depicted through lines 91 to 94.

Cooling of the rising hot air again takes place through cooling pipes 82, 83 or 84, 85 respectively, disposed one above the other which are disposed in the narrow distance of two carrier T-rails 78, 79 or 80, 81 respectively. The cooling pipes 82, 83 or 84, 85 respectively have at their lowest point in each instance two small channels 95 to 98 in which potentially developing condensation water can collect. Thereby that these channels are provided with breaks, they can be emptied specifically into the U-rails 86 or 87, which subsequently serve as condensation water channel. Depending on the quantity of condensation water to be expected, the U-rails 86 or 87 are emptied either by suction or by draining or the condensation water remains in the U-rails 86, 87 for evaporation. The cooling pipes 82 to 85 and the carrier T-rails 78 to 81 are fastened on the concrete ceiling 10. The fastening means required for this purpose are not specifically shown.

The U-rails can also be fastened on the concrete ceiling 10, for example with the aid of metal wires.

Figure 5:
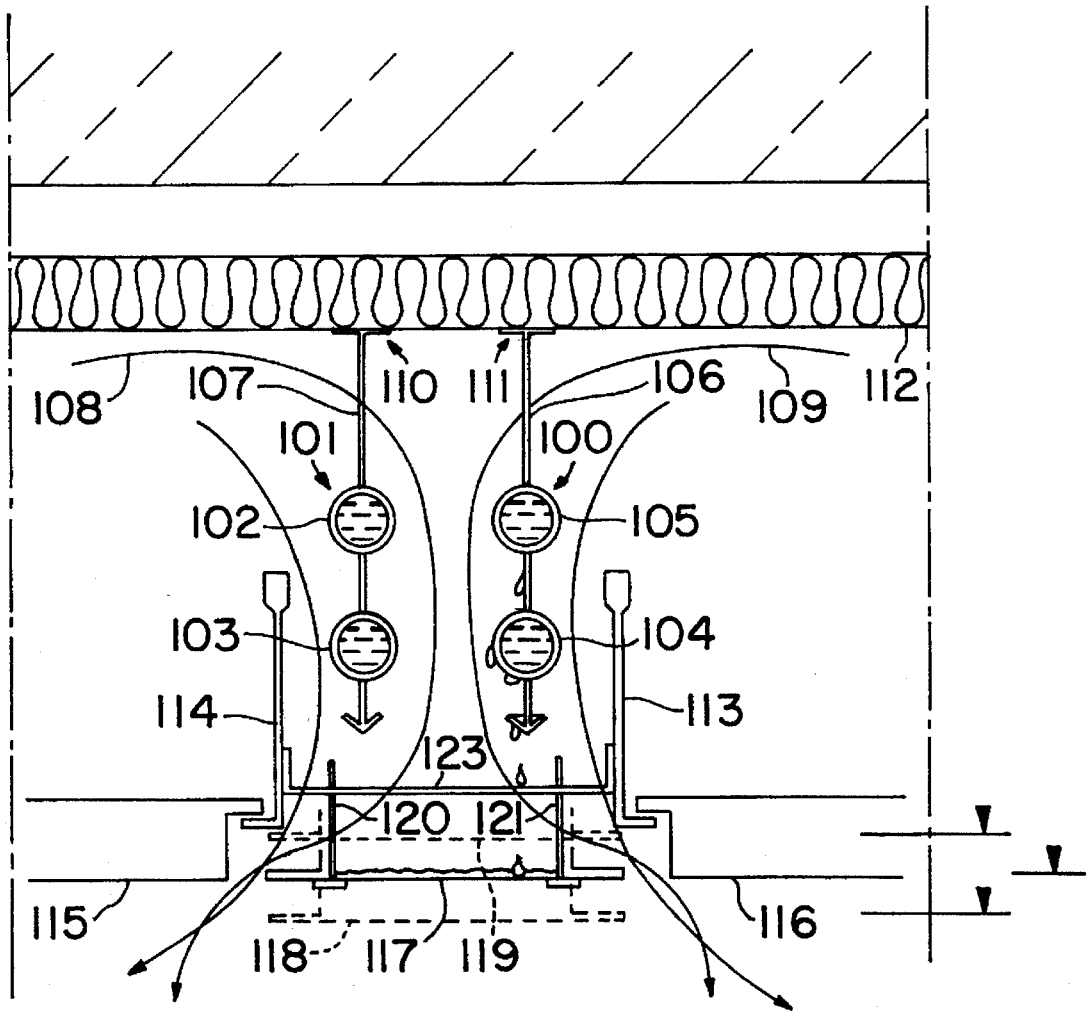
FIG. 5—a modification of the suspended ceiling depicted in FIG. 4.

In FIG. 5 is depicted a further variant of the invention in which cooling pipe pairs 100, 101 are disposed side by side and permit the flow of air between the cooling pipe pairs 100, 101. The flow of air through the cooling pipe pairs 100, 101 is ensured through openings 106, 107 in mounting webs 110, 111 of the cooling pipe pairs 100, 101. These mounting webs 110, 111 are connected with a damping plate 112 disposed below a concrete ceiling 10. The damping plate 112 can also assume the function of a fire protection plate.

The suspended ceiling in the arrangement according to FIG. 5 comprises essentially perforated sheet metal cassettes 115, 116 resting on carrier elements 113, 114 which, in turn, are connected by means of a mounting element (not shown) with the damping plate 112 or with side walls which extend perpendicularly to the ceiling 10 and are not shown in FIG. 5.

Between the carrier elements 113, 114 is disposed a U-rail 117 the function of which corresponds to U-rail 86 according to FIG. 4. In contrast to the U-rail 86, however, U-rail 117 is movable in the vertical direction so that the downward flow of the cooled air can be regulated.

Therein an enlargement or a reduction of the air penetration openings is possible. The reduction of the air penetration openings is shown by the representation of the U-rails in dashed lines in an upper position which is denoted by 119. In the position shown, the reduction is such that the air flow is completely closed off.

In a lower position of the U-rail designated as 118, a maximum of air flow is possible.

The adjustment of the vertical position of the U-rail 117 can be achieved by set screws 120, 121 which are screwed through a fastening element 123 and support the U-rail 117.

It is understood that the suspension can also comprise a uniform plate provided with perforations. Above this sieve-form suspension can be disposed the cooling pipes with a condensation water channel. The perforations of the plate in this case serve for the rising and/or descending air.

I claim:

1. Cooling system which can be fastened on a ceiling (10) with a suspension (16 to 19, 41 to 44, 69 to 71, 115, 116) provided underneath the ceiling (10) disposed above a space (8) to be cooled, and with a plurality of adjacent cooling pipes (11 to 14; 48, 49; 82 to 85, 102 to 105) between ceiling (10) and suspension (16 to 19, 41 to 44, 69 to 71, 115, 116), the space (8) to be cooled and the space between ceiling (10) and suspension (16 to 19, 41 to 44, 69 to 71, 115, 116) are connected with each other through an air current path, condensation water channels are disposed in vertical arrangements underneath the cooling pipes (11 to 14), characterized in that the condensation water channels are first panels (18, 19) providing along with second panels (16, 17) which are disposed below and between horizontally adjacent cooling pipes (11 to 14) said suspension in which the air current paths (36, 37) are provided by gaps between the first and second panels (16 to 19).

2. Cooling system as stated in claim 1, characterized in that the space (8) to be cooled and the space between ceiling (10) and suspension (16 to 19, 41 to 44, 69 to 71, 115, 116) are connected with each other through two air current paths (53, 51) wherein via the one air current path (53) air flows from space to be cooled into the space between ceiling (10) and suspension (16 to 19, 41 to 44, 69 to 71, 115, 116) and wherein via the other air current path (51) air flows from the space between ceiling (10) and suspension (16 to 19, 41 to 44, 69 to 71, 115, 116) into the space (8) to be cooled.

3. Cooling system as stated in claim 1, characterized in that the air current path is formed by an opening (36, 37) in the suspension (16 to 19, 41 to 44, 69 to 71, 115, 116).

4. Cooling system as stated in claim 2, characterized in that both air current paths are formed by openings (51, 53) disposed in the suspension (16 to 19, 41 to 44, 69 to 71, 115, 116).

5. Cooling system as stated in claim 2 or 4, characterized in that the condensation water channel (44) is disposed in the vicinity of an opening (51, 53).

6. Cooling system as stated in claim 1, characterized in that between ceiling (10) and cooling pipes (11 to 14; 48, 49; 82 to 85; 102 to 105) is disposed a sound-damping layer (29).

7. Cooling system as stated in claim 1, characterized in that two or several cooling pipes (11 to 14; 48, 49; 82 to 85; 102 to 105) are disposed one above other and have a given distance from horizontally adjacent cooling pipes disposed one above the other.

8. Cooling system as stated in claim 1, characterized in that a cooling pipe (49) is in physical contact with an upper side of the suspension (41, 42).

9. Cooling system as stated in claim 1, characterized in that the condensation water channel comprises a U-rail (86) and disposed underneath the cooling pipes (11, 12; 13, 14) and that webs (78, 79) extending perpendicularly to the U-rail (86) and having a carrier web extending transversely for the suspension (69 to 71) are provided. 05; 48, 49; 82 to 85; 102 to 105)

10. Cooling system as stated in claim 1, characterized in that the suspension comprises said first and second panels (16 to 19) of different widths wherein wider second panels (16, 17) are disposed below and between horizontally adjacent cooling pipes (11, 12; 13, 14) and narrower first panels (18) are disposed vertically below the cooling pipes (11 to 14).

11. Cooling system as stated in claim 10, characterized in that the suspension comprises panels (41, 42) which are arcuate and hooked into carrier elements (45, 46) provided on the cooling pipes.

12. Cooling system as stated in claim 1, characterized in that a closure closes the air current paths off.

13. Cooling system as stated in claim 12, characterized in that the closure comprises vertically adjustable closure profiles (117).

* * * * *